US006028574A

United States Patent [19]

Bancal

[11] Patent Number: 6,028,574

[45] Date of Patent: Feb. 22, 2000

[54] DEVICE FOR SWITCHING THE ANODE OF A FLAT DISPLAY SCREEN

[75] Inventor: Bernard Bancal, Luynes, France

[73] Assignee: Pixtech S.A., Rousset, France

[21] Appl. No.: 08/660,708

[22] Filed: Jun. 6, 1996

[30] Foreign Application Priority Data

Jun. 8, 1995 [FR] France ..... 95/07016

[51] Int. Cl.[7] ..... G09G 3/22

[52] U.S. Cl. ..... 345/74; 345/75

[58] Field of Search ..... 345/55, 60, 65, 345/74, 75

[56] References Cited

U.S. PATENT DOCUMENTS

| | | | |
|---|---|---|---|
| 4,384,287 | 5/1983 | Sakuma | 345/60 |
| 4,495,445 | 1/1985 | Turkey | 345/75 |
| 4,940,916 | 7/1990 | Borel et al. . | |
| 5,150,011 | 9/1992 | Fujieda | 345/60 |
| 5,442,259 | 8/1995 | Lameris et al. | 345/75 |
| 5,612,712 | 3/1997 | Kumar et al. | 345/75 |
| 5,670,974 | 9/1997 | Ohba et al. | 345/60 |
| 5,721,472 | 2/1998 | Browning et al. | 345/74 |

*Primary Examiner*—Matthew Luu
*Attorney, Agent, or Firm*—Arthur L. Plevy

[57] ABSTRACT

A flat display screen comprises a microtip cathode for electronically bombarding an anode including at least two groups of alternate conductive strips with phosphor strips and a control circuit adapted to sequentially address each group. The control circuit includes means for applying, at least temporarily, to each group of conductive strips a voltage lower than the minimum biasing voltage of the cathode's microtips.

10 Claims, 4 Drawing Sheets

DEVICE FOR SWITCHING THE ANODE OF A FLAT DISPLAY SCREEN

BACKGROUND OF THE INVENTION

1. Field of the Invention

The present invention relates to a flat display screen comprising a microtip cathode for electronically bombarding an anode including phosphor elements.

The present invention relates to flat display screens, and more particularly to so-called cathodoluminescent screens, whose anode supports phosphors separated one from the other by insulating strips which can be excited by electronic bombardment. The electronic bombardment requires the phosphors to be biased and can be generated by microtips, low extraction potential layers or thermo-ionic sources. The invention more particularly applies to the switching of the anode of a flat display screen.

To simplify, the following description only deals with color microtip screens, but the invention generally applies to the various above-mentioned screens and analog.

2. Discussion of the Related Art

FIG. 1 represents the functional structure of a flat microtip screen.

Such a microtip screen is mainly formed by a cathode 1 including microtips 2 and a gate 3 with holes 4 corresponding to the positions of microtips 2. Cathode 1 is disposed so as to face a cathodoluminescent anode 5, formed on a glass substrate 6 that constitutes the screen surface.

The operation and an exemplary structure of such a microtip screen are described in U.S. Pat. No. 4,940,916 assigned to Commissariat à l'Energie Atomique.

Cathode 1 is arranged in columns and is constituted, onto a glass substrate 10, of cathode conductors arranged in meshes from a conductive layer. The microtips 2 are disposed onto a resistive layer 11 that is deposited onto the cathode conductors and are disposed inside the meshes defined by the cathode conductors. FIG. 1 partially represents the inside of a mesh, without the cathode conductors. Cathode 1 is associated with gate 3 which is arranged in rows. An insulating layer (not shown) is interposed between the cathode conductors and gate 3. The intersection of a row of gate 3 with a column of cathode 1 defines a pixel.

This device uses the electric field generated between cathode 1 and gate 3 so that electrons are transferred from microtips 2 toward phosphors 7 of anode 5. In color screens, the anode 5 is provided with alternate phosphor strips 7, each corresponding to a color (red, green, blue). The strips are separated one from the other by an insulating material 8. The phosphors 7 are deposited onto electrodes 9, which are constituted by corresponding strips of a transparent conductive layer such as indium and tin oxide (ITO). The groups of red, green and blue strips are alternatively biased with respect to cathode 1 so that the electrons extracted from the microtips 2 of one pixel of the cathode/gate are alternatively directed toward the facing phosphors 7 of each color.

Generally, the rows of gate 3 are sequentially biased at a voltage of approximately 80 volts whereas the phosphor strips (for example 7*g* in FIG. 1) that must be excited are biased at a voltage of approximately 400 volts, the other strips (for example 7*r* and 7*b* in FIG. 1) are at a zero voltage. The columns of cathode 1, whose potential determines for each row of gate 3 the brightness of the pixel defined by the intersection of the cathode column and the gate row in the considered color, are brought to respective voltages ranging between a maximum emission potential and a zero-emission potential (for example 0 and 30 volts, respectively).

The values of the biasing voltages are determined by the characteristics of the phosphors 7 and microtips 2. Conventionally, below a voltage difference of 50 volts between the cathode and the gate, no electron emission occurs, and the maximum emission used corresponds to a voltage difference of 80 volts.

FIG. 2 represents an exemplary conventional biasing or switching device, of a group of conductive strips 9 supporting phosphors. Such a device is integrated in a control circuit (not shown) of the screen. For color screens, the control circuit includes three of these devices (one for each color).

A conventional switching device includes two MOS power transistors MP and MN, having a P-channel and an N-channel, respectively. The source of transistor MP is connected to a positive addressing voltage $V_{Ah}$ (for example approximately 400 volts), whereas its drain is connected to the drain of transistor MN, whose source is connected to a zero voltage (ground M). The drains of transistors MP and MN are connected to a first terminal of a resistor $R_1$, whose other terminal forms an output terminal 20 of the device. Terminal 20 is connected to the related group of phosphor supporting strips.

The gates of transistors MP and MN receive control signals $C_P$ and $C_N$, respectively, which are delayed over time to switch the device output 20 between voltage $V_{Ah}$ and ground. The control signals $C_P$ and $C_N$ are two-state signals. Signals $C_P$ and $C_N$ are at a low state during the frame time of the color with which the device is associated and at a high state during the frame times of the other two colors. The high and low states of the control signals $C_P$ and $C_N$ are, for example, 0 and 5 volts, respectively.

Signals $C_P$ and $C_N$ are provided to control terminals 21 and 22, respectively. The gate of transistor MP is connected to terminal 21, through a resistor $R_3$ connected in series with a capacitor $C_1$. The gate of transistor MN is connected to terminal 22 through a resistor $R_4$. The gate of transistor MP is also connected to voltage $V_{Ah}$ through a Zener diode $D_{Z1}$ and a resistor $R_2$ which are parallel connected.

The device output 20 is switched between voltage $V_{Ah}$ and ground on the edges of the control signals $C_P$ and $C_N$. Capacitor $C_1$ is designed to enable switching of transistor MP from the control signal $C_P$, whose potentials are referenced to ground and not to voltage $V_{Ah}$.

To turn on transistor MP, the voltage of its gate should be set to a value lower than voltage $V_{Ah}$. Assuming that transistor MP is off, a falling edge of signal $C_P$ is provided, as a pulse, by capacitor $C_1$ to the gate of transistor MP, which is turned on. In contrast, the occurrence of the next (rising) edge of signal $C_P$ turns off transistor MP by setting its gate to a voltage equal to voltage $V_{Ah}$. The Zener diode $D_{Z1}$ is designed to protect transistor MP by limiting the voltage difference between its gate and its source to a value corresponding to the Zener voltage, for example 4.7 volts. The Zener diode $D_{Z1}$ is also designed to prevent the gate voltage from substantially exceeding voltage $V_{Ah}$.

However, for the edges of signal $C_P$ to cause the switching of transistor MP, a condition must be satisfied. The time constant, resulting from the gate capacitance of transistor MP associated with resistor $R_2$, should be higher than the time constant resulting from the association of resistor $R_3$ with capacitor $C_1$, and the gate capacitance of transistor MP. In other words, the values of resistors $R_2$ and $R_3$ and capacitor $C_1$ are selected so that $R_2C_g > R_3(C_1+C_g)$, where $C_g$ is the gate capacitance of transistor MP.

Transistor MN is controlled by signal $C_N$. Since transistor MN is an N-channel transistor and its source is connected to ground, signal $C_N$ can be applied to its gate without using a capacitor. When signal $C_N$ is in a high state (for example 5 volts), transistor MN is on because its gate voltage is higher than its source voltage. In contrast, when signal $C_N$ is grounded, transistor MN is off.

A drawback of conventional color screens is that, when one group of strips of a predetermined color is biased, a spurious emission of the other two colors occurs.

This phenomenon is illustrated in FIG. 3 which is a schematic cross-sectional view along a row of gate 3 of a screen pixel. For the sake of clarity, only a few microtips 2 are represented in FIG. 3 whereas there are in practice several thousand microtips per screen pixel.

In the case of a green frame, the conductive strips 9 supporting the green phosphors 7*g* are addressed and biased at a positive voltage, for example 400 volts, whereas the conductive strips 9*r* and 9*b* respectively supporting the red 7*r* and blue 7*b* phosphors are in a quiescent state, at a zero voltage.

When the microtips 2 of a predetermined pixel emit electrons, some spurious electrons are not attracted by the green phosphor strips 7*g* but by the red 7*r* or blue 7*b* phosphor strips of this pixel, or even of adjacent pixels facing the rows of gate 3. This spurious bombardment is sometimes caused by a remaining charge of the red and blue phosphor strips even though the corresponding conductive strips 9*r* and 9*b* are at a zero voltage. Spurious capacitances are present between the phosphor strips and the supporting conductive strips. So, even when the conductive strip is connected to ground, some phosphor strips may remain biased at a voltage higher than the minimum biasing voltage (0 volt) of the microtips because of these spurious capacitances and of the high addressing voltage (approximately 400 volts). The spurious bombardment can be increased by a ballistic effect, which causes that some electrons emitted by the microtips facing the red or blue strips have not enough time to be deviated and attracted by the green phosphor strips. In FIG. 3, the electron path is symbolically represented by arrows, the path of the spurious electrons being represented by dotted lines.

SUMMARY OF THE INVENTION

An object of the present invention is to avoid this drawback by providing a flat display screen comprising microtips in which the phosphor supporting conductive strips of the anode are switched so that all the electrons emitted by the microtips are effectively attracted by the phosphor strips of the desired color.

A further object of the present invention is to provide such a switching by using supply voltages which are conventionally available in a control circuit of the screen.

To achieve these objects, the present invention provides a flat display screen including a cathode for electronically bombarding an anode including at least two groups of alternate conductive strips supporting phosphor strips and a control circuit adapted to sequentially address each of the groups. The control circuit includes circuitry for applying, at least temporarily, to each group of conductive strips a voltage lower than a minimum cathode voltage.

According to an embodiment of the invention, the circuitry include, for each group of conductive strips, a device for switching between a positive anode voltage and a quiescent voltage lower than the minimum cathode voltage.

According to an embodiment of the invention, the minimum cathode voltage corresponds to ground, the quiescent voltage of a group of conductive strips being negative.

According to an embodiment of the invention, the circuitry include, for each group of conductive strips, a device for switching between a positive anode voltage and a quiescent voltage that is equal to the minimum cathode voltage. The device includes means for using the transition between the addressing voltage and the quiescent voltage of a group of conductive strips to generate a pulse at a voltage lower than the minimum cathode voltage on another group of conductive strips.

According to an embodiment of the invention, the switching device includes two MOS transistors whose respective gates receive the suitable control signals, the drain of a first P-channel transistor forming an output terminal designed to be connected, through a first resistor, to a group of phosphor supporting strips, the source of the first transistor being connected to the positive anode voltage and its gate being connected, through a first Zener diode connected in parallel with a second resistor, to the positive anode voltage and, through a third resistor connected in series with a first capacitor, to a first control terminal which receives a first two-state signal.

According to an embodiment of the invention, the drain of a second N-channel transistor is connected to the drain of the first transistor, the source of the second transistor being connected to the quiescent voltage and its gate being connected, through a fourth resistor connected in series with a second capacitor, to a second control terminal which receives a second two-state signal and, through a second Zener diode connected in parallel with a fifth resistor, to the quiescent voltage.

According to an embodiment of the invention, the drain of a second N-channel transistor is connected, through a second Zener diode, to the output terminal of the device, the source of the second transistor being grounded and its gate being connected, through a fourth resistor, to a second control terminal which receives a second two-state signal, the maximum amplitude of the negative pulses being determined by the value of the second Zener diode.

According to an embodiment of the invention, a fifth high value resistor is connected in parallel with the second Zener diode.

According to an embodiment of the invention, the flat display screen comprises three groups of alternate conductive strips including phosphor strips, each corresponding to a color and three switching devices. The first control signals respectively associated with the devices are successively at a high state during the frame times of the colors with which they are associated and, simultaneously, to ground during a predetermined duration between two color frames.

According to an embodiment of the invention, the cathode is of the microtip type.

The foregoing and other objects, features, aspects and advantages of the invention will become apparent from the following detailed description of embodiments, given by way of illustration and not of limitation with reference to the accompanying drawings.

BRIEF DESCRIPTION OF THE DRAWINGS

For the sake of clarity, the various figures are not drawn to scale and the same elements are designated with the same reference characters.

DETAILED DESCRIPTION

Figure 1:
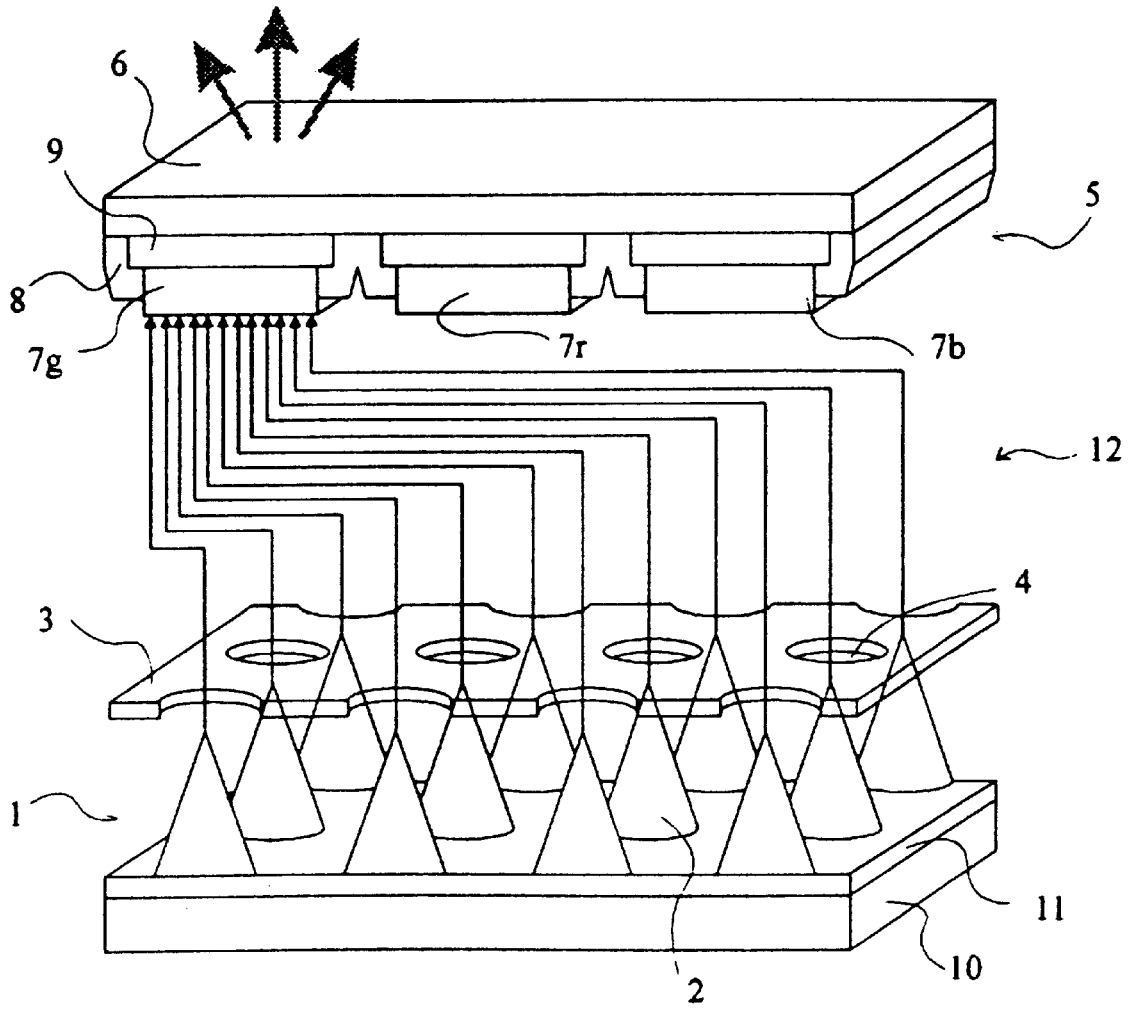
Fig 1 (PRIOR ART)
FIGS. 1–3, described above, explain the state of the art and the problem encountered.
Figure 3:
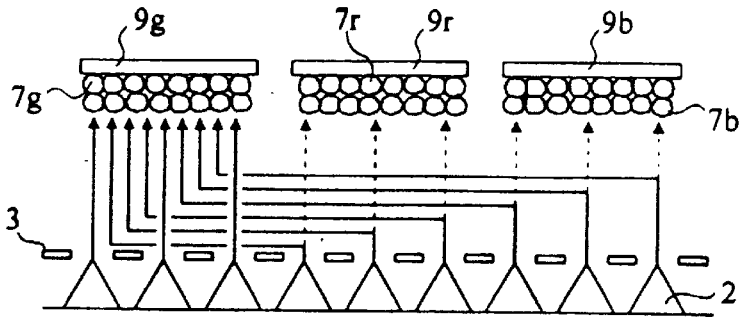
Fig 3 (PRIOR ART)
Figure 2:
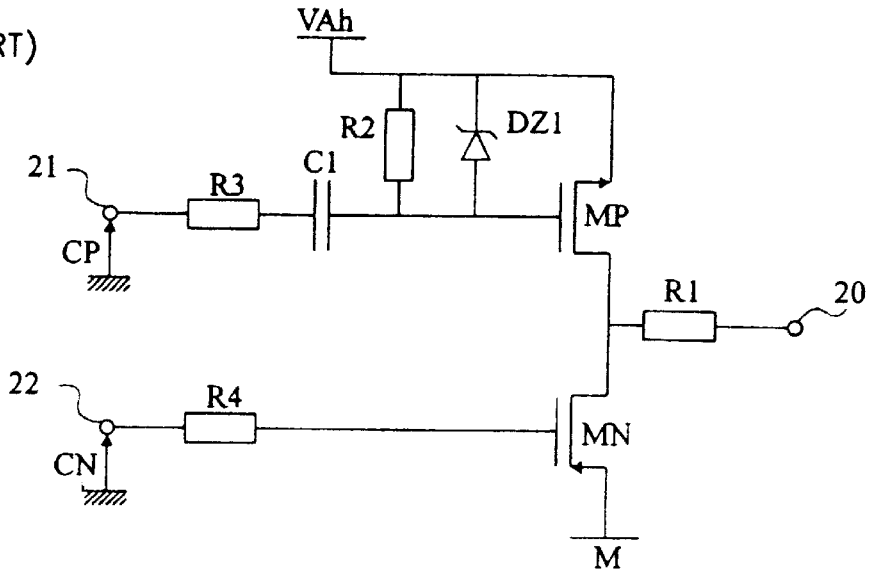
Fig 2 (PRIOR ART)

A distinctive feature of the present invention is to inhibit the attraction effect of the phosphor strips supported by non-addressed conductive strips (9 in FIG. 1), by applying to these strips, at least temporarily, a voltage lower than the minimum microtip biasing voltage, thereby eliminating any remaining charge of the non-addressed phosphor strips.

Figure 4:
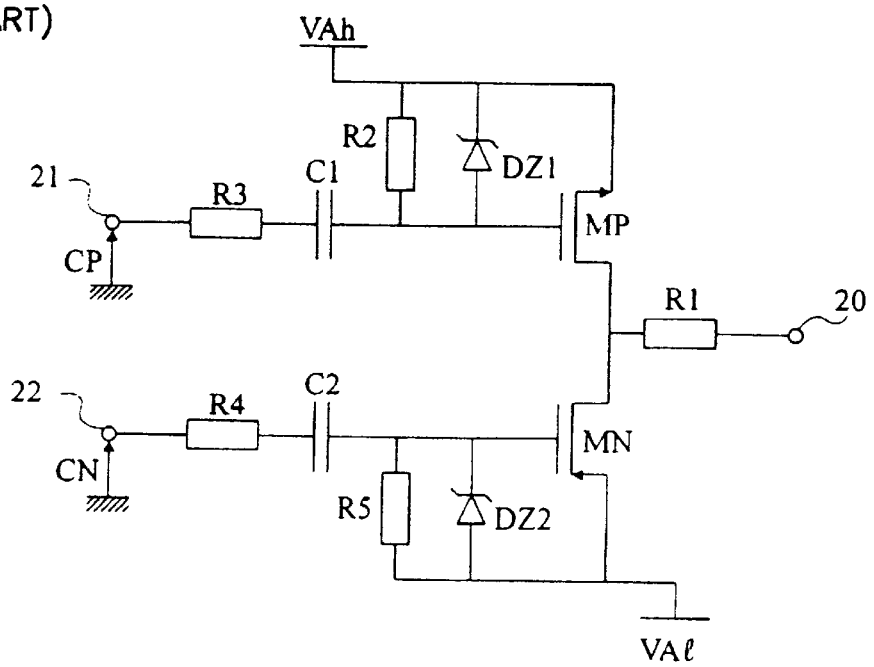
FIG. 4 represents a first embodiment of a device for switching the anode of a flat display screen according to the invention.

FIG. 4 illustrates a first embodiment of a device for switching an anode according to the invention. The quiescent voltage of the phosphor strips is a voltage $V_{Al}$ lower than the minimum biasing voltage of the cathode microtips. In the considered example where the cathode columns are biased between 0 and 30 volts as a function of the desired pixel's brightness in the considered color, a negative voltage $V_{Al}$ is selected. Thus, only the phosphor strips whose conductive strips are addressed, i.e., set to a positive addressing voltage $V_{Ah}$ (for example approximately 400 volts), can receive electrons emitted by the microtips.

A switching device according to this first embodiment includes two power MOS transistors MP and MN, whose drains are connected to a first terminal of a first resistor $R_1$, whose other terminal forms an output 20 of the device to which a group of conductive strips supporting phosphor strips is connected. A first P-channel MOS transistor MP has, as above, its source connected to the addressing voltage $V_{Ah}$. The gate of transistor MP is connected, through a first Zener diode $D_{Z1}$ connected in parallel with a second resistor $R_2$, to the addressing voltage $V_{Ah}$ and, through a third resistor $R_3$ connected in series with a first capacitor $C_1$, to a first terminal 21 receiving a first control signal $C_P$.

According to the invention, a similar circuit is reproduced for a second N-channel transistor MN, its source being connected to the quiescent voltage $V_{Al}$. In other words the gate of transistor MN is connected, through a fourth resistor $R_4$ connected in series with a second capacitor $C_2$, to a second control terminal 22 which receives a second control signal $C_N$. In addition, the gate of transistor MN is connected, through a second Zener diode $D_{Z2}$ connected in parallel with a fifth resistor $R_5$, to the quiescent voltage $V_{Al}$.

The control signals $C_P$ and $C_N$ correspond to the signals used to switch conventional devices and are two-state signals (for example 0 and 5 volts) inverted one with respect to the other. Capacitor $C_2$ is designed to cause the switching of transistor MN, whose source is at a negative voltage, by a signal $C_N$ whose low state is the ground.

To turn on transistor MN, the voltage of its gate is set to a voltage higher than voltage $V_{Al}$. Assuming that transistor MN is off, a rising edge of signal $C_N$ is provided, as a pulse, by capacitor $C_2$ to the gate of transistor MN, which is turned on. The Zener diode $D_{Z2}$ protects transistor MN by limiting the voltage difference between its gate and its source to a value corresponding to the Zener voltage, for example 4.7 volts. In contrast, the occurrence of the next (falling) edge of signal $C_N$ causes transistor MN to be turned off by setting its gate to a voltage at least equal to or slightly lower than voltage $V_{Al}$.

However, as for transistor MP, a condition must be satisfied for the edges of signal $C_N$ to cause transistor MN to switch. Care should be taken that the time constant, resulting by the gate capacitance of transistor MN associated with resistor $R_5$, is higher than the time constant resulting from the association of resistor $R_4$ with capacitor $C_2$ and the gate capacitance of transistor MN. In other words, the values of resistors $R_4$ and $R_5$ and capacitor $C_2$ are selected so that $$R_5C_g > R_4(C_2+C_g),$$

where $C_g$ is the gate capacitance of transistor MN.

A device such as represented in FIG. 4 is repeated for each group of phosphor strips of the anode.

Thus, when a group is no longer addressed, the corresponding transistor MN becomes conductive and the conductive strips of this group are then at a negative voltage $V_{Al}$. Then, the ability of the phosphor strips to attract electrons emitted by the microtips is inhibited by accelerating the discharge of the spurious capacitors between the phosphors and the phosphor supporting strips.

According to the invention, voltage $V_{Al}$ is selected substantially lower than the minimum biasing voltage of the microtips. The value of voltage $V_{Al}$ ranges, for example from −100 to −200 volts.

By way of a specific exemplary embodiment, a switching device such as represented in FIG. 4 can be fabricated with components having the following values for an addressing voltage $V_{Ah}$ of approximately 400 volts and a quiescent voltage of approximately −200 volts:

| | |
|---|---|
| $R_1$, $R_3$, $R_4$ | 1 kΩ; |
| $R_2$, $R_5$ | 470 kΩ; |
| $C_1$, $C_2$ | 10 nF; and |
| $D_{Z1}$, $D_{Z2}$ | 4.7 volts. |

Figure 5:
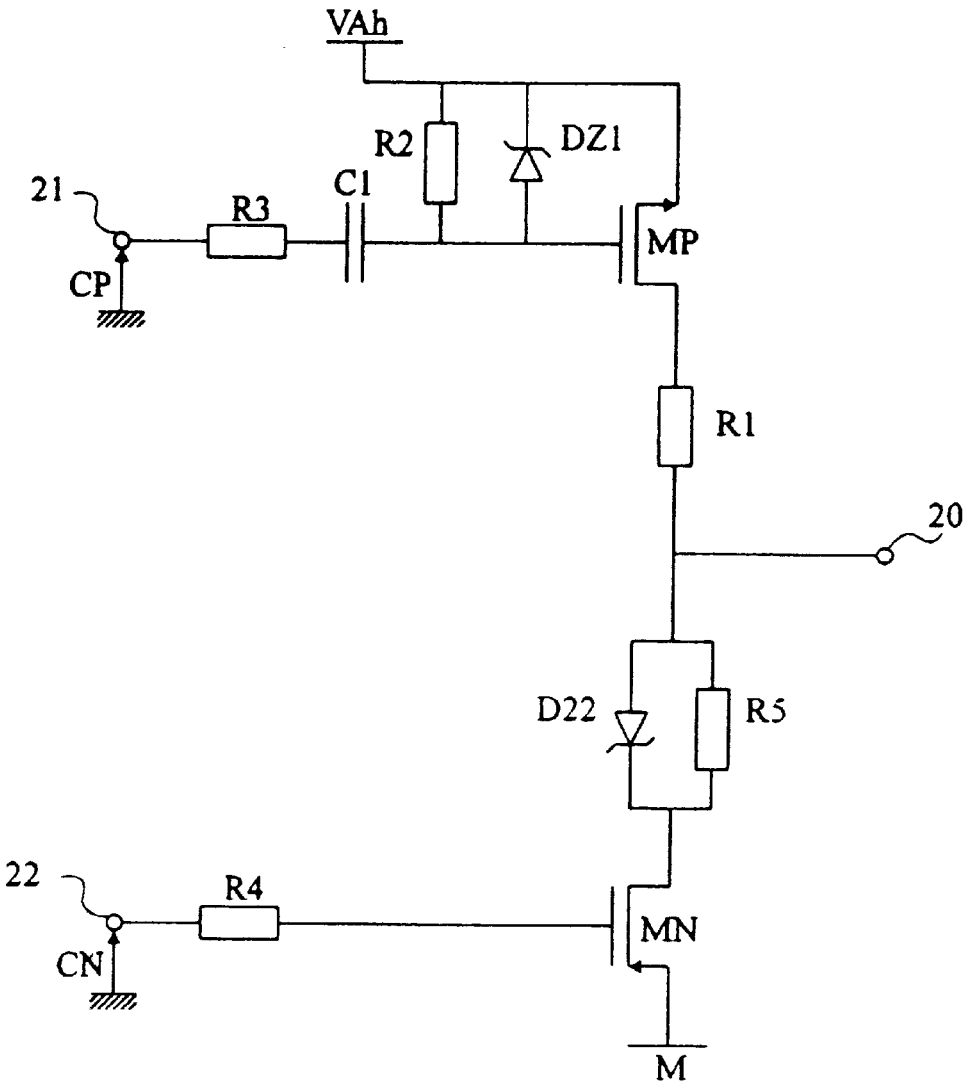
FIG. 5 represents a second embodiment of a device for switching the anode of a flat display screen according to the invention.

FIG. 5 illustrates a second embodiment of an anode switching device according to the invention. This device differs from the one represented in FIG. 4 in that it does not require a highly negative supply voltage as a quiescent voltage for the conductive strips which are not addressed.

According to this second embodiment, the capacitive coupling between two adjacent conductive strips is used to obtain negative pulses at the switching.

Two adjacent conductive strips of a color screen form a capacitor. The interconnection of the conductive strips supporting phosphors of a same color corresponds, for the control circuit, to a global resulting capacitor.

Figure 6:
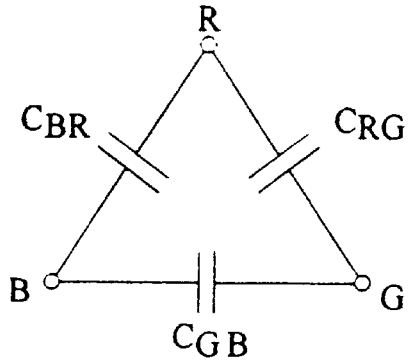
FIG. 6 is an equivalent electrical diagram of the anode of a flat display screen illustrating its capacitive characteristics.

As regards the capacitive characteristics, FIG. 6 represents the equivalent simplified electric diagram of an anode of a color screen. The resulting capacitors $C_{GB}$, $C_{BR}$ and $C_{RG}$, respectively, between the groups of conductive strips of the anode form a delta network, whose apices correspond to the connection terminals of each color G, B and R, respectively. Each terminal G, B and R is connected to an output terminal 20 of a switching device according to the invention.

Because of the delta coupling, the switching of a group of conductive strips to a quiescent voltage at the end of an addressing of the group generates, through capacitive coupling, a negative pulse on the other two groups of strips. Conventional switching devices aim at minimizing these negative pulses through the grounded N-channel transistor (MN, FIG. 1).

In contrast, according to the second embodiment, the invention aims at increasing these negative pulses to cause an optimal discharge of the phosphors which have just been addressed and thus to prevent the phosphors of the non-addressed strips from attracting electrons.

As shown in FIG. 5, a switching device according to this second embodiment includes two power MOS transistors MN and MP. As above, a switching device is associated with each group of phosphor strips, i.e., each terminal R, G and B of FIG. 6 is connected to a terminal 20 of a device such as represented in FIG. 5.

The circuit associated with a first P-channel transistor MN is the same as that of the first embodiment.

According to the invention, the gate of a second N-channel transistor MN is connected through a fourth resistor $R_4$, to a second control terminal 22 which receives a second two-state control signal $C_N$, which is shifted over time with respect to the control signal $C_P$. The source of transistor MN is connected to ground M, which is here the minimum biasing voltage of the cathode microtips. The drain of transistor MN is connected to the output terminal 20 through a fifth high value resistor $R_5$ in parallel with a second Zener diode $D_{Z2}$.

Diode $D_{Z2}$ switches terminal 20 between voltage $V_{Ah}$ and ground M at the end of an addressing of the group of conductive strips associated with the device. Diode $D_{Z2}$ also prevents a group of conductive strips, which must not be addressed, from being set to a positive voltage by the rising edges of the other two groups further to capacitive coupling.

The high value resistor $R_5$ limits the absorption of negative current, due to capacitive coupling, at the end of an addressing of a group of strips, thereby decreasing damping of the negative pulses on the other two groups of strips.

Figure 7:
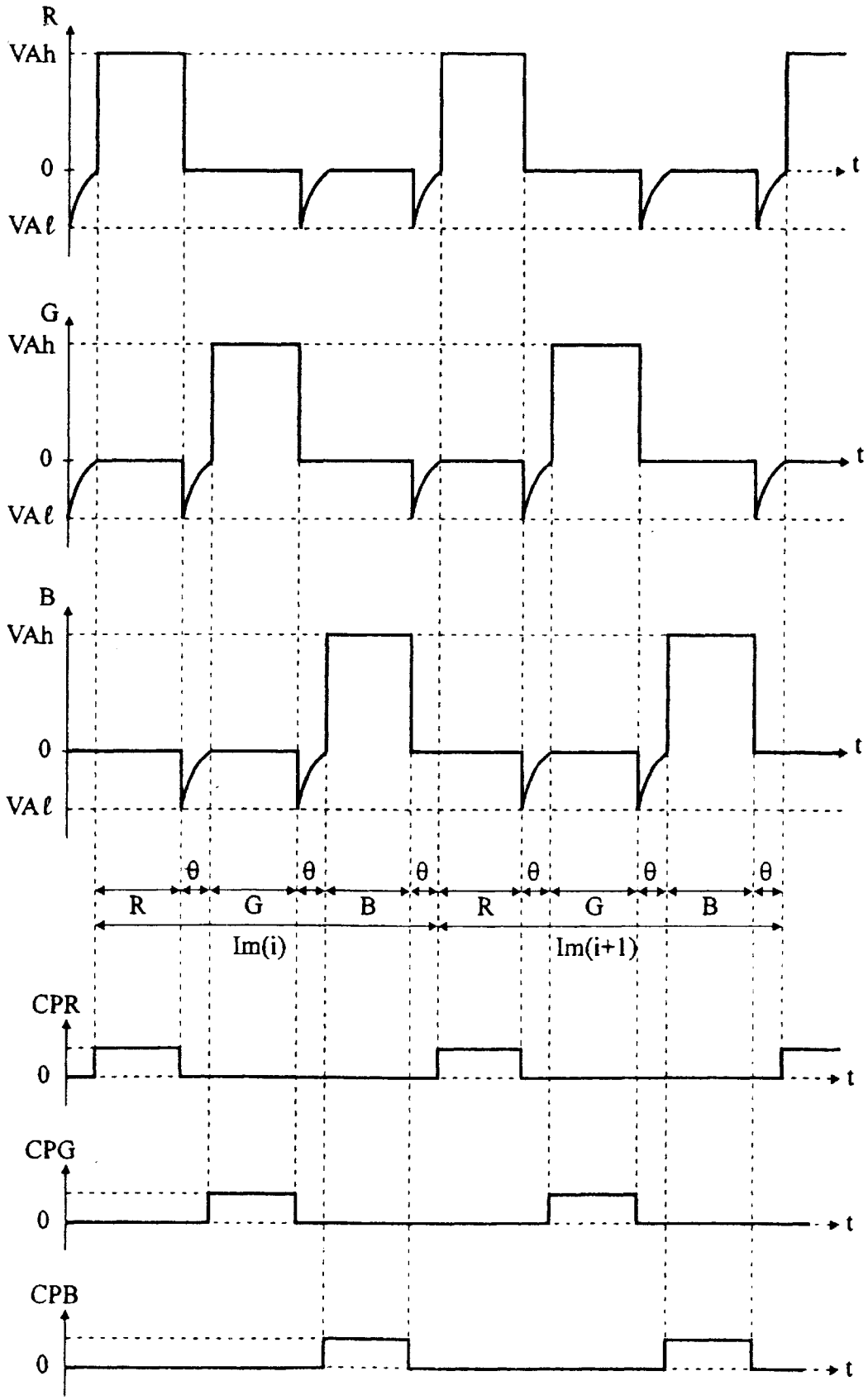
FIG. 7 represents time diagrams of various signals of the anode of a color screen switched by devices as shown in FIG. 5.

The operation of the switching device will be better understood with relation to the following description of FIG. 7.

The control signals associated with the various devices are achieved so that there remains between each color frame time a period during which all transistors MP are off. In other words, the control signals of two successive color frames are separated by a time interval during which negative pulses are favored.

An advantage of this second embodiment is that it does not require any additional voltage supply source.

FIG. 7 represents time diagrams of the operation of an anode of a color screen controlled by switching devices as shown in FIG. 6. FIG. 7 represents, during two time intervals Im(i) and Im(i+1) corresponding to the display time of two pictures, the waveform of the signals present between terminals R, G and B interconnecting the groups of red, green and blue phosphor strips, respectively, and the waveform of the control signals $C_{PR}$, $C_{PG}$ and $C_{PB}$, respectively, associated with the switching devices of these groups. The control signals $C_N$ (not shown) of the devices correspond to signals $C_P$ with a time shift. The switching of the gate rows and cathode columns in each picture time is conventionally achieved.

During each picture time, the groups of phosphor strips are sequentially addressed and brought to voltage $V_{Ah}$ by the control signals. Thus, each signal $C_P$ includes, in each picture time, a grounded flat portion having a duration corresponding to the picture time.

Now, the case of a flat portion of signal $C_{PR}$, i.e. a red frame time, is considered. It is thus assumed that transistor MP of the device associated with terminal R is on and that the corresponding transistor MN is off, whereas the transistors MN of the devices, which are respectively associated with terminals B and G, are off and that the transistors MN of these devices are on.

At the falling edge of the flat portion of signal $C_{PR}$, the transistor MP associated with terminal R is turned off whereas the rising edge of signal $C_N$ turns on transistor MN. Due to the Zener diode $D_{Z2}$, the voltage at terminal R is immediately brought back to ground, resistor $R_5$ being short-circuited. The falling edge of the voltage at terminal R causes, because of capacitive coupling, a negative pulse at terminals G and B, i.e., on the conductive strips associated therewith. Diodes $D_{Z2}$ associated with terminals G and B are then reverse biased. However, because of their size, they limit the amplitude $V_{Al}$ of the negative pulses. Resistors $R_5$ associated with terminals G and B generate, with the spurious capacitances $C_{RG}$ and $C_{BR}$, respectively, a time constant which delays the damping of the negative pulses, transistors MN of the devices being on. Resistor $R_5$ might be omitted, the leakage resistance of diode $D_{Z2}$ limiting the negative current.

The negative pulses present at terminals G and B disappear at the occurrence of the rising edge of the next signal $C_{PG}$, thereby bringing terminal G to voltage $V_{Ah}$ to address the group of green strips.

At the occurrence of the rising edge of signal $C_{PG}$, the voltage at terminal G is immediately set to the addressing voltage $V_{Ah}$ by the conduction of transistor MP of the switching device associated therewith after the turning off of transistor MN of this device. The Zener diodes $D_{Z2}$ of the switching devices associated with terminals B and R, respectively, which are then forward biased (transistors MN of the devices being on) prevent positive pulses from occurring at terminals B and R, resulting from the spurious capacitances $C_{GB}$ and $C_{RG}$. In the absence of the Zener diodes $D_{Z2}$, the positive pulses are damped according to the time constant resulting from the association of resistors $R_5$ of these devices with capacitors $C_{GB}$ and $C_{RG}$, respectively.

Then, the green frame time lasts for the whole duration of the positive flat portion of signal $C_{PG}$.

The above described operation applies for each flat portion of one of signals $C_{PR}$, $C_{PG}$ or $C_{PB}$.

The duration t between each flat portion is fixed as a function of the desired duration for the negative pulses of the desired frame times. The presence of intervals t during which all the transistors MP are blocked decreases the picture time that is available for addressing the groups of strips. By way of a specific example, for picture times of 10 ms which correspond to a frequency of 100 Hz, intervals t having a duration ranging from 10 $\mu$s to 1 ms can be selected. The frame time which remains available is then at least 7 ms, which is highly sufficient to allow a sequential addressing of all the rows of the gate during each frame time.

The maximum amplitude $V_{Al}$ of the negative pulses is determined by the value of the Zener diode. A sufficiently high value (for example ranging from 100 to 200 volts) should be selected to provide sufficiently negative pulses.

Although, according to this embodiment, the non-addressed phosphor supporting strips are not permanently at a voltage lower than the minimum biasing voltage of the cathode microtips, the strips are at a low voltage temporarily, twice during for each quiescent period. This is sufficient to fully discharge the phosphors and prevent spurious electrons from being attracted by the phosphors of the non-addressed strips.

In an exemplary implementation, for a screen having a diagonal of 15 cm, with a 0.3-mm pixel pitch, where capacitors $C_{GB}$, $C_{BR}$ and $C_{RF}$ have values of approximately 5 nF and an addressing voltage $V_{Ah}$ of approximately 400 volts, a switching device such as represented in FIG. 5 can be achieved with components having the following values:

| | |
|---|---|
| $R_1$, $R_3$, $R_4$ | 1 kΩ; |
| $R_2$ | 470 kΩ; |
| $R_5$ | 100 kΩ to 1 MΩ; |
| $C_1$ | 10 nF; |
| $D_{Z1}$ | 4.7 volts; and |
| $D_{Z2}$ | 200 volts. |

As is apparent to those skilled in the art, various modifications can be made to the above-described preferred embodiments. More particularly, each of the described components can be replaced with one or more elements having the same function. In addition, the values given by way of example can be modified as a function of the characteristics of the screen and of its control circuit. Although the above description has referred to color screens only, the invention also applies to monocolor screens including two groups of strips of the same color.

I claim:

1. A flat display screen comprising:

a cathode (1);

an anode (5) including at least two groups of alternate conductive strips (9), said alternate conductive strips supporting phosphors (7); and, a control circuit adapted to sequentially address each of said groups, and including means for applying, at least temporarily, to each group of conductive strips (9) a quiescent voltage ($V_{Al}$) lower than the minimum cathode voltage, said means for applying being adapted for switching between a positive anode voltage ($V_{Ah}$) and said quiescent voltage ($V_{Al}$) and comprising:

first and second MOS transistors (MP, MN) having respective gates adapted to receive suitable control signals;

a drain of said first transistor (MP) forming an output terminal (20) connected through a first resistor ($R_1$) to a group of phosphor supporting strips;

a source of said first transistor (MP) being connected to said positive anode voltage ($V_{Ah}$); and, said gate of said first transistor (MP) being connected, through a first Zener diode ($D_{Z1}$) connected in parallel with a second resistor ($R_2$) to said positive addressing voltage ($V_{Ah}$ ) and, through a third resistor ($R_3$) connected in series with a first capacitor ($C_1$), to a first control terminal (21) adapted to receive a two-state signal ($C_P$).

2. The flat display screen of claim 1, wherein said minimum cathode voltage corresponds to ground (M), said quienscent voltage ($V_{Al}$) of a group of conductive strips (9) being negative.

3. The flat display screen of claim 1, wherein said means include, for each group of strips (9), a device for switching between a positive anode voltage ($V_{Ah}$) and a quiescent voltage (M) that is equal to the minimum cathode, said device including means for using the transition between the addressing voltage ($V_{Ah}$) and the quiescent voltage (M) of a group of conductive strips (9) to generate a pulse at a voltage ($V_{Al}$) lower than the minimum cathode voltage on another group of strips (9).

4. The flat display screen of claim 1, wherein the drain of a second N-channel transistor (MN) is connected to the drain of said first transistor (MP), the source of said second transistor (MN) being connected to the quiescent voltage ($V_{Al}$) and its gate being connected, through a fourth resistor ($R_4$) connected in series with a second capacitor ($C_2$), to a second control terminal (22) receiving a second two-state signal ($C_N$) and, through a second Zener diode ($D_{Z2}$ ) connected in parallel with a fifth resistor ($R_5$), to said quiescent voltage ($V_{Al}$).

5. The flat display screen of claim 3, wherein the drain of a second N-channel transistor (MN) is connected, through a second Zener diode ($D_{Z2}$), to the output terminal (20) of the device, the source of said second transistor (MN) being connected to ground (M) and its gate being connected, through a fourth resistor ($R_4$), to a second control terminal (22) receiving a second two-state signal ($C_N$), the maximum amplitude ($V_{Al}$) of the negative pulses being determined by the value of the second Zener diode ($D_{Z2}$).

6. The flat display screen of claim 5, wherein a fifth high value resistor ($R_5$) is connected in parallel with said second Zener diode ($D_{Z2}$).

7. The flat display screen of claim 5, including three groups of alternate conductive phosphor supporting strips, each corresponding to a color, and three switching devices, and wherein the first control signals ($C_P$) respectively associated with the devices are successively at a high state during frame times of the colors with which they are respectively associated and, simultaneously, to ground (M) during a predetermined duration (t) between two color frames.

8. The flat display screen of claim 1, wherein the cathode is of the microtip type.

9. A flat display screen comprising:

a cathode including microtips;

an anode including a plurality of groups of alternate conductive strips, said alternate conductive strips supporting phosphors;

control means for sequentially addressing each of said plurality of groups;

means for selectively applying a positive anode voltage to a first group selected from said plurality of groups;

means for selectively applying a quiescent voltage approximately equal to a minimum cathode voltage to said first group; and, means for selectively applying a pulse at a voltage lower than the minimum cathode voltage to at least a second group of strips selected from said plurality of groups, said means for applying said pulse being dependent upon a transition between said positive anode voltage and said quiescent voltage selectively applied to said first group of conductive strips.

10. A method for operating a flat display screen including a cathode including microtips, and an anode including a plurality of groups of alternate conductive strips, said alternate conductive strips supporting phosphors, said method comprising the steps of:

sequentially addressing each of said plurality of groups;

selectively applying a positive anode voltage to a first group selected from said plurality of groups;

selectively applying a quiescent voltage approximately equal to a minimum cathode voltage to said first group; and, selectively applying a pulse at a voltage lower than the minimum cathode voltage to at least a second group of strips selected from said plurality of groups, said means for applying said pulse being dependent upon a transition between said positive anode voltage and said quiescent voltage selectively applied to said first group of conductive strips.

* * * * *